US010777031B2

(12) United States Patent
Deak et al.

(10) Patent No.: US 10,777,031 B2
(45) Date of Patent: Sep. 15, 2020

(54) COIN DETECTION SYSTEM

(71) Applicant: MultiDimension Technology Co., Ltd., Zhangjiagang (CN)

(72) Inventors: James Geza Deak, Zhangjiagang (CN); Haiping Guo, Zhangjiagang (CN)

(73) Assignee: MultiDimension Technology Co., Ltd., Zhangjiagang (CN)

( * ) Notice: Subject to any disclaimer, the term of this patent is extended or adjusted under 35 U.S.C. 154(b) by 0 days.

(21) Appl. No.: 15/321,156

(22) PCT Filed: Jun. 12, 2015

(86) PCT No.: PCT/CN2015/081290
§ 371 (c)(1),
(2) Date: Dec. 21, 2016

(87) PCT Pub. No.: WO2015/196932
PCT Pub. Date: Dec. 30, 2015

(65) Prior Publication Data

US 2017/0193725 A1 Jul. 6, 2017

(30) Foreign Application Priority Data

Jun. 23, 2014 (CN) ..... 2014 1 0284349

(51) Int. Cl.
*G07D 5/08* (2006.01)

(52) U.S. Cl.
CPC ..... *G07D 5/08* (2013.01)

(58) Field of Classification Search
CPC .. G07D 5/00; G07D 5/02; G07D 5/08; G07D 5/10

(Continued)

(56) References Cited

U.S. PATENT DOCUMENTS 4,086,527 A 4/1978 Cadot
4,664,244 A * 5/1987 Wright ..... G07D 5/02 194/317

(Continued)

FOREIGN PATENT DOCUMENTS

CN 1289429 3/2001
CN 1650191 8/2005

(Continued)

OTHER PUBLICATIONS https://en.wikipedia.org/wiki/Gradiometer. (Year: 2019).*

(Continued)

*Primary Examiner* — Jeffrey A Shapiro
(74) *Attorney, Agent, or Firm* — Schwegman Lundberg & Woessner, P.A.

(57) ABSTRACT

A coin detection system comprises an excitation coil, a radial magnetic gradiometer, an axial magnetic gradiometer, a signal excitation source, a drive circuit, an analog front-end circuit and a processor. After the excitation coil is excited by the signal excitation source and the drive circuit, the excitation coil generates an excitation magnetic field parallel to the axial direction of a coin, and under the influence of the excitation magnetic field, the coin generates an induced magnetic field through eddy currents induced in the coin; the radial magnetic gradiometer and the axial magnetic gradiometer detect the magnetic field components of the magnetic field in the radial direction and the axial direction of the coin, and the detected signal is transmitted to the analog front-end circuit for amplification; the processor processes and then outputs the amplified signal transmitted by the analog front-end circuit, and the material, design, denomination, etc. of the coin are obtained according to the amplitude, phase, and other information contained in the output signal.

11 Claims, 9 Drawing Sheets

(58) Field of Classification Search
USPC ..... 194/302–325; 235/379
See application file for complete search history.

(56) References Cited

U.S. PATENT DOCUMENTS

| | | | | | |
|---|---|---|---|---|---|
| 4,870,360 | A * | 9/1989 | Collins | G07D 5/02 | 324/235 |
| 4,971,187 | A * | 11/1990 | Furuya | G07D 5/02 | 194/302 |
| 5,323,891 | A * | 6/1994 | Waite | G07D 5/08 | 194/318 |
| 5,337,877 | A * | 8/1994 | Waite | G01B 7/10 | 194/317 |
| 5,462,151 | A * | 10/1995 | Furneaux | G07D 5/02 | 194/318 |
| 6,150,809 | A | 11/2000 | Tiernan et al. | | |
| 6,288,538 | B1 * | 9/2001 | Aruga | G01B 7/34 | 194/320 |
| 6,382,386 | B1 * | 5/2002 | Gaponyuk | G07D 5/08 | 194/318 |
| 6,667,615 | B2 * | 12/2003 | Aruga | G01D 5/204 | 194/320 |
| 6,822,443 | B1 * | 11/2004 | Dogaru | G01R 33/093 | 324/235 |
| 6,851,541 | B1 * | 2/2005 | Howells | G07D 5/08 | 194/317 |
| 2002/0144877 | A1 * | 10/2002 | Baker | G07D 5/08 | 194/319 |
| 2005/0016815 | A1 * | 1/2005 | Martin | G07D 3/06 | 194/317 |
| 2008/0000751 | A1 | 1/2008 | Ohtomo | | |
| 2010/0308804 | A1 * | 12/2010 | Ghislanzoni | G01D 1/00 | 324/207.23 |
| 2013/0006552 | A1 * | 1/2013 | Peyton | G01V 3/12 | 702/57 |
| 2015/0070035 | A1 * | 3/2015 | Blau | G07D 5/08 | 324/693 |

FOREIGN PATENT DOCUMENTS

| | | |
|---|---|---|
| CN | 101527056 | 9/2009 |
| CN | 103003711 | 3/2013 |
| CN | 202916902 U | 5/2013 |
| CN | 103617669 | 3/2014 |
| CN | 104134269 | 11/2014 |
| CN | 204129826 | 1/2015 |
| DE | 2425803 | 12/1975 |
| EP | 2098999 | 9/2009 |
| JP | H10500515 | 1/1998 |
| JP | H10111966 | 4/1998 |
| JP | 2008084290 | 4/2008 |
| JP | 2009234457 | 10/2009 |
| JP | 2013101129 | 5/2013 |
| WO | WO-1996027859 | 9/1996 |
| WO | WO-1997013224 | 4/1997 |
| WO | WO-2015196932 | 12/2015 |

OTHER PUBLICATIONS https://en.wikipedia.org/wiki/Magnetometer (Year: 2019).*

"International Application No. PCT/CN205/081290, International Search Report and Written Opinion dated Aug. 14, 2015", (dated Aug. 14, 2015), 11 pgs.

"Chinese Application No. 201410284349.2, First Office Action dated Dec. 25, 2015", (dated Dec. 25, 2015), 18 pgs.

"Chinese Application No. 201410284349.2, Second Office Action dated Sep. 12, 2016", (dated Sep. 12, 2016), 10 pgs.

"Chinese Application No. 2014102843492, Initial Search dated Dec. 16, 2015", (dated Dec. 16, 2015), 2 pgs.

"European Application No. 15811990.9, Extended European Search Report dated Jan. 29, 2018", (dated Jan. 29, 2018), 6 pgs.

* cited by examiner

| | Magnetic field component (Oe) | | | |
|---|---|---|---|---|
| Frequency (Hz) | 160 | | 9800 | |
| Coin type | Radial | Axial | Radial | Axial |
| 0.1CNY | 0.108 | 0.068 | 0.052 | 0.048 |
| 0.5CNY | 0.127 | 0.078 | 0.057 | 0.061 |
| 1CNY | 0.311 | 0.081 | 0.176 | 0.078 |
| 1JPY | 0.027 | 0.050 | 0.150 | 0.171 |
| 5JPY | 0.023 | 0.029 | 0.246 | 0.172 |
| 10JPY | 0.059 | 0.060 | 0.412 | 0.171 |
| 100JPY | 0.005 | 0.008 | 0.142 | 0.118 |
| 2EUR | 0.032 | 0.039 | 0.325 | 0.181 |
| USICENT | 0.010 | 0.038 | 0.103 | 0.169 |
| USSCENT | 0.006 | 0.012 | 0.101 | 0.119 |

Fig. 10

COIN DETECTION SYSTEM

PRIORITY CLAIM TO RELATED APPLICATIONS

This application is a U.S. national stage application filed under 35 U.S.C. § 371 from International Application Serial No. PCT/CN2015/081290, which was filed 12 Jun. 2015, and published as WO2015/196932 on 30 Dec. 2015, and which claims priority to Chinese Application No. 201410284349.2, filed 23 Jun. 2014, which applications and publication are incorporated by reference as if reproduced herein and made a part hereof in their entirety, and the benefit of priority of each of which is claimed herein.

TECHNICAL FIELD

The present invention relates to a coin detection system, and in particular, to a coin detection system that uses magnetoresistive sensors to form a magnetic gradiometer.

BACKGROUND ART

Coins are an indispensable part of modern society, are a necessary tool for humans to exchange materials, and have a large circulation in our daily life. As the coins are increasingly widely used, traffic, financial, and other institutions increasingly rely on applications that judge denominations and authenticity of the coins and count the coins. At present, there are mainly the following several manners of counting the coins and identifying authenticity. (1) An alternating magnetic field is applied to a coin, then an induced eddy current field thereof is measured to judge the material of the coin, so as to identify the authenticity thereof; such a method measures an axial magnetic field of the coin mainly by using an induction coil or a combination of an induction coil and a Hall sensor, this can only measure one kind of signals that identify features, while for different coins having similar resonance frequencies, amplitudes or phases, such a method evidently cannot judge the authenticity accurately. (2) Multiple magnetoresistive sensors are used to form a sensor unit array to detect magnetic field distribution around the coin, so as to judge the denomination of the coin and the authenticity thereof, for example, the patent application CN103617669A discloses a coin detection device, such a device can also detect signals in only one direction, for coins that have similar diameters and have similar responses in the same direction, accuracy of the judgment result of such a method is not high enough, and the measurement result includes a new signal generated by an applied pulse field, subsequent processing is required to remove the signal, the operation process is relatively complicated, and the resolution may be reduced. (3) The authenticity of the coin is detected by performing variable-frequency input on a transmitting coil and measuring output of a receiver in different frequency points, for example, U.S. Pat. No. 4,086,527 discloses a testing method, although the method can obtain information such as amplitude, phase, and resonance frequency of the output signal, a single-axis sensor is still employed, and it is very difficult to identify some coins that have similar features. In addition, the authenticity may also be tested with methods such as using a pulse field for excitation and then removing the pulse field, and performing phase shifting, but all the methods can only provide one kind of signals that identify features, which cannot identify the coins that have the similar features accurately. As the coin forging technology is becoming increasingly excellent, the existing coin detection device cannot meet high precision requirements for coin detection in the modern institutions such as transportation and financial.

SUMMARY OF THE INVENTION

An objective of the present invention is to provide a coin detection system with a simple structure, high accuracy, high sensitivity and a wide dynamic linear range, so as to overcome the defects existing in the prior art.

In order to achieve the foregoing objective, the present invention adopts the following technical solution: a coin detection system, wherein the coin detection system includes an excitation coil, a radial magnetic gradiometer and an axial magnetic gradiometer;

the excitation coil is used for providing an axial excitation magnetic field for a to-be-detected coin, the excitation magnetic field induces eddy currents inside the to-be-detected coin, and the eddy currents generate an induced magnetic field;

the radial magnetic gradiometer includes at least two radial magnetoresistive sensors and the axial magnetic gradiometer includes at least two axial magnetoresistive sensors, the radial magnetoresistive sensors and the axial magnetoresistive sensors being symmetrically distributed relative to a central plane or a central point of the excitation coil respectively; the radial magnetic gradiometer is used for detecting a difference of magnetic field components of the induced magnetic field on two corresponding sides of the excitation coil and along a radial direction of the to-be-detected coin, and the axial magnetic gradiometer is used for detecting a difference of magnetic field components of the induced magnetic field on two corresponding sides of the excitation coil and along an axial direction of the to-be-detected coin, the two corresponding sides referring to two opposite sides along an axial direction of the excitation coil; and the excitation coil is positioned such that a surface of the to-be-detected coin is parallel to the central plane of the excitation coil, and a distance between the surface of the to-be-detected coin and the central plane is at least half of the height of the excitation coil.

Preferably, the coin detection system further includes: a signal excitation source and a drive circuit that are used for exciting the excitation coil, an analog front-end circuit for amplifying signals generated by the radial magnetic gradiometer and the axial magnetic gradiometer, and a processor for calculating a real component and an imaginary component of an amplified signal output by the analog front-end circuit.

Preferably, a signal generated by the signal excitation source includes an AC signal, the AC signal including at least one frequency component; the processor calculates the real component and the imaginary component of the amplified signal corresponding to each frequency component.

Preferably, the signal excitation source is further used for applying a DC signal in the duration of the AC signal, and the excitation magnetic field generated by the excitation coil is a superposed field of a DC magnetic field and an AC magnetic field.

Preferably, when the to-be-detected coin is made of a ferromagnetic material or the surface of the to-be-detected coin is coated with a ferromagnetic material, an amplitude value of the output signal is reduced after the DC magnetic field is applied; and when the to-be-detected coin is made of a conductor, the DC magnetic field does not affect the amplitude value of the output signal.

Preferably, the coin detection system is capable of detecting amplitude values of a real component and an imaginary component corresponding to each type of coins.

Preferably, the excitation coil is a single coil or an array formed by superposing multiple coils, and a diameter of a circumference encircled by the excitation coil is greater than or equal to that of the to-be-detected coin.

Preferably, the radial magnetic gradiometer is located at an inner edge of the excitation coil and located below an edge of the to-be-detected coin, and the radial magnetoresistive sensors are symmetrical relative to the center of the excitation coil; the axial magnetic gradiometer is located inside the excitation coil and located at or close to a lower side of the center of the to-be-detected coin, and the axial magnetoresistive sensors are symmetrically distributed relative to the center of the excitation coil along the axial direction of the excitation coil.

Preferably, the coin detection system further includes a first PCB and a second PCB, the radial magnetoresistive sensors are located on the first PCB and the second PCB respectively, the axial magnetoresistive sensors are located on the first PCB and the second PCB respectively, and the excitation coil is fixed between the first PCB and the second PCB; and the to-be-detected coin is located above the first PCB and the second PCB.

Preferably, the radial magnetoresistive sensors are X-axis linear sensors, the axial magnetoresistive sensors are Z-axis linear sensors, sensing directions of the X-axis linear sensors are parallel to the radial direction of the to-be-detected coin, and sensing directions of the Z-axis linear sensors are parallel to the axial direction of the to-be-detected coin.

Preferably, the X-axis linear sensors and the Z-axis linear sensors are of a structure of a single resistor, half bridge or full bridge, and the single resistor, bridge arms of the half bridge or bridge arms of the full bridge consist of one or more magnetoresistive elements electrically connected with each other.

Preferably, the magnetoresistive elements are Hall or SMRE (semiconductor magnetoresistive element), anisotropic magnetoresistance (AMR), giant magnetoresistance (GMR) or tunnel magnetoresistance (TMR) elements.

Preferably, the coin detection system further includes a positioning device for positioning a position where the to-be-detected coin is placed, such that the to-be-detected coin is close to one side of the radial magnetic gradiometer and the axial magnetic gradiometer.

Compared with the prior art, the prevent invention has the following technical effects:

(1) Radial and axial magnetic gradiometers are used to detect radial and axial magnetic field components of an eddy current magnetic field induced by a to-be-detected coin, which achieves dual-axis measurement and is not affected by an excitation magnetic field, and this can improve accuracy of the measurement greatly.

(2) When the to-be-detected coin is not placed, the two magnetic gradiometers may not display any excitation signal, such that the excitation signal will not generate a saturation effect, and the gain can be improved as much as possible, thereby improving the resolution.

(3) The radial and axial magnetic gradiometers consist of linear magnetoresistive sensors, for example, TMR sensors, and this can improve sensitivity of the coin detection system and increase the dynamic linear range; in addition, relative to the coil, the magnetoresistive sensor is smaller in size and lower in cost, such that the coin detection system has a more compact structure and can also save the cost.

(4) The two magnetic gradiometers in the present invention can implement temperature compensation for system responses and eliminate thermal drift errors.

BRIEF DESCRIPTION OF THE DRAWINGS

In order to describe the technical solutions in technologies of embodiments of the present invention more clearly, the accompanying drawings to be used in the description about the technologies of the embodiments are briefly introduced in the following. It is apparent that the accompanying drawings in the following description are only some embodiments of the present invention. Persons of ordinary skill in the art can also obtain other accompanying drawings according to the accompanying drawings without making creative efforts.

FIG. 10 is a diagram of measurement results of radial and axial magnetic field components of different types of coins at different frequencies.

DETAILED DESCRIPTION OF THE PREFERRED EMBODIMENTS

The present invention is described in detail below with reference to the accompanying drawings and in combination with embodiments.

Embodiments

Figure 1:
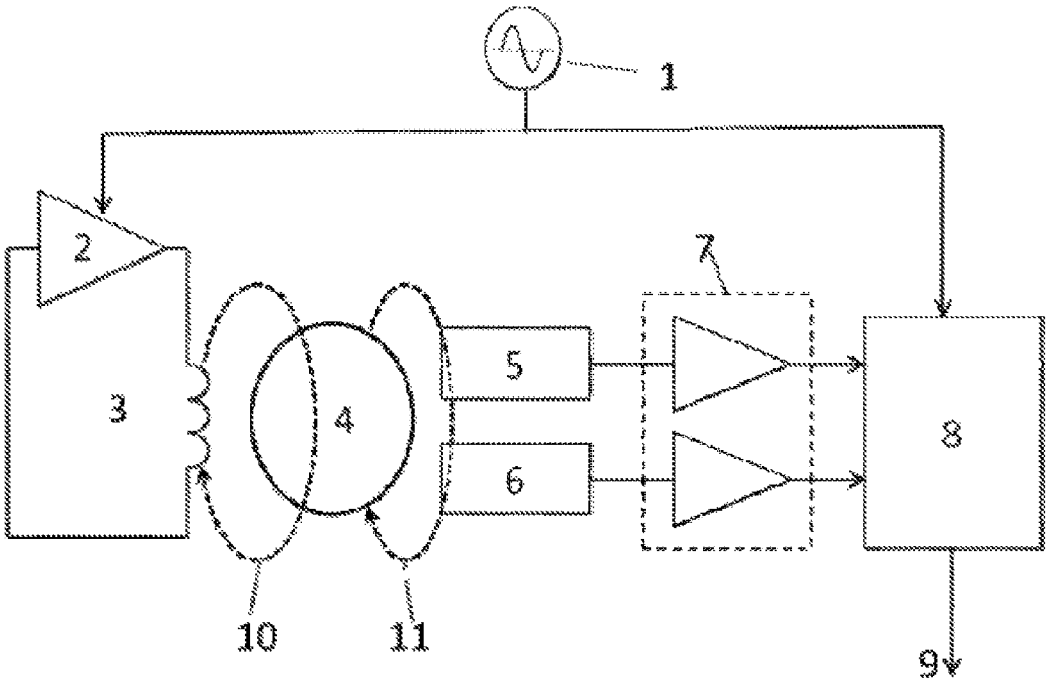
FIG. 1 is a schematic structural diagram of a coin detection system in the present invention.

FIG. 1 is a schematic structural diagram of a coin detection system in the present invention. The coin detection system includes a signal excitation source 1, a drive circuit 2, an excitation coil 3, a to-be-detected coin 4, a radial magnetic gradiometer 5, an axial magnetic gradiometer 6, an analog front-end circuit 7, and a processor 8. During operation, after the excitation coil 3 is excited by the signal excitation source 1 and the drive circuit 2, the excitation coil 3 generates an excitation magnetic field 10 parallel to the axial direction of the to-be-detected coin 4, and under the influence of the excitation magnetic field 10, the to-be-detected coin 4 generates eddy currents in the coin and then induces a magnetic field 11; the radial magnetic gradiometer 5 and the axial magnetic gradiometer 6 detect a difference of magnetic field components of the magnetic field 11 on two corresponding sides of the excitation coil 3 in the radial and axial directions of the to-be-detected coin 4 respectively; the corresponding two sides here refer to two opposite sides along an axial direction (as shown by the vertical dotted line in FIG. 2) of the excitation coil, which refer to upper and lower sides in this embodiment; then, the detected signal is transmitted to the analog front-end circuit 7 for amplification; the processor 8 processes the amplified signal transmitted by the analog front-end circuit 7 and then outputs through an output end 9; the processor 8 may include an MCU or a DSP, the output signal is a voltage signal which may be converted to a magnetic field signal, and the magnetic field signal includes a real portion and an imaginary portion; the output signal is relevant to the material, size, and design of the coin and the position of the coin relative to the radial magnetic gradiometer 5 and the axial magnetic gradiometer 6; in order to avoid influences caused by different positions, a positioning column is used to position the to-be-detected coin. Different coins have standard values, and by comparing and analyzing detection results and the standard values, denominations and authenticity thereof can be judged. In this embodiment, the signal excitation source 1 is a sinusoidal signal, but it may also be an AC signal that includes one or more frequency components. After the AC signal is successfully excited, detection is carried out, and the measurement results are compared and analyzed with the standard values. Also, after the AC signal is successfully excited and an output signal is detected, a DC magnetic field may be applied to the to-be-detected coin 4, the DC magnetic field may be generated by an external permanent magnet and may also be generated by applying a DC signal to the excitation coil 3 through the signal excitation source 1, which is the latter in this embodiment, and then the output signal is detected once again. In this case, for coins made of a conductor, the measurement results are not affected, but for coins made of a ferromagnetic material or surface-coated with a ferromagnetic layer (e.g., nickel), the measurement results will change, the amplitude value of the output signal may tend to decrease, and this can further improve the accuracy of identification of authenticity of the coin.

Figure 2:
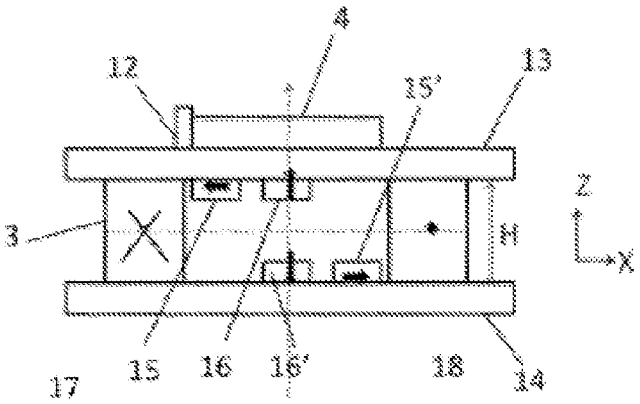
FIG. 2 is a sectional view of some details of the coin detection system in the present invention.
Figure 3:
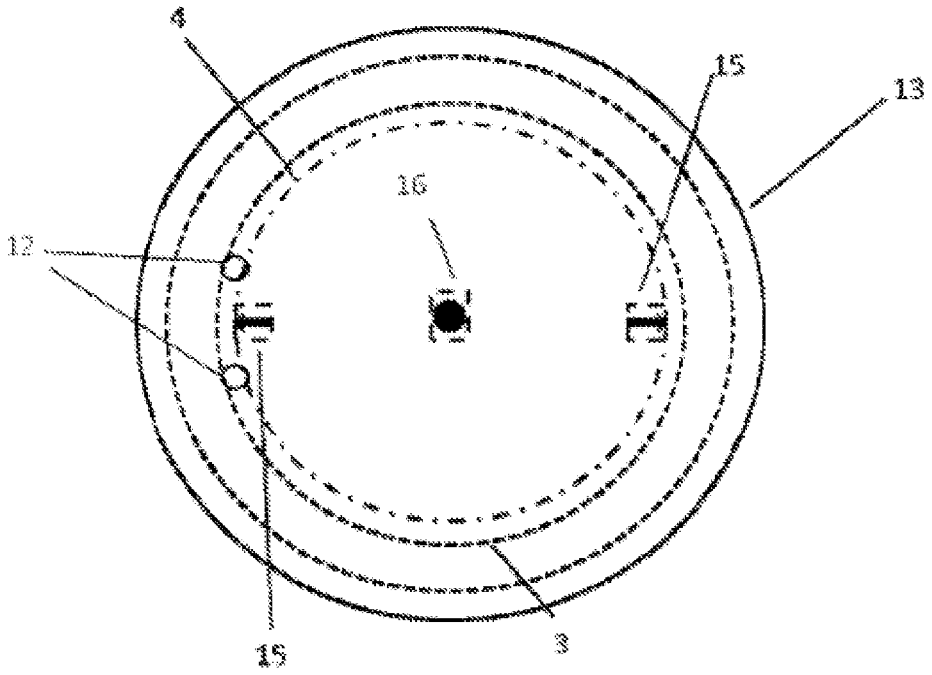
FIG. 3 is a top view of some details of the coin detection system in the present invention.

FIG. 2 and FIG. 3 are respectively a sectional view and a top view of details such as the excitation coil, the to-be-detected coin, and the radial and axial magnetic gradiometers in the coin detection system. The radial magnetic gradiometer and the axial magnetic gradiometer are surrounded by the excitation coil, and they include two X-axis linear magnetoresistive sensors 15, 15' and two Z-axis linear magnetoresistive sensors 16, 16' respectively, wherein the X-axis linear magnetoresistive sensors 15, 15' are not only located at an inner edge of the excitation coil 3 and symmetrical relative to the center of the excitation coil 3, but also symmetrically located below an edge of the to-be-detected coin 4; the Z-axis linear magnetoresistive sensors 16, 16' are not only symmetrical relative to the center of the excitation coil, but also distributed below the center of the to-be-detected coin 4, or located near a lower side of the center of the to-be-detected coin 4. Objectives of symmetrical distribution of the X-axis linear magnetoresistive sensors 15, 15' and the Z-axis linear magnetoresistive sensors 16, 16' are as follows: (1) in the absence of a to-be-detected coin but in the presence of an excitation magnetic field, output signals of the radial magnetic gradiometer and the axial magnetic gradiometer are both 0; and (2) in the presence of a to-be-detected coin, the radial magnetic gradiometer and the axial magnetic gradiometer can measure corresponding magnetic field gradients. In the present invention, the X-axis linear magnetoresistive sensors 15, 15' may also be distributed on the same left side or right side of the excitation coil 3, and be longitudinally symmetrical. Certainly, the radial magnetic gradiometer and the axial magnetic gradiometer may also be located outside the excitation coil, which is not limited in the present invention.

The X-axis linear magnetoresistive sensor 15 and the Z-axis linear magnetoresistive sensor 16 are disposed on a PCB 13 near the to-be-detected coin, the X-axis linear magnetoresistive sensor 15' and the Z-axis linear magnetoresistive sensor 16' are disposed on a PCB 14 away from the to-be-detected coin 4, and the PCB 13 and the PCB 14 are identical. Sensing directions of the X-axis linear magnetoresistive sensors 15, 15' are parallel to a radial direction of the to-be-detected coin 4, that is, the sensing directions point to edges of the to-be-detected coin 4 from the center thereof, while sensing directions of the Z-axis linear magnetoresistive sensors 16, 16' are parallel to an axial direction of the to-be-detected coin 4, that is, the sensing directions point to the outside from the center of the to-be-detected coin 4. In FIG. 2, as placement directions of the PCB 13 and the PCB 14 are opposite, the sensing directions of the X-axis linear magnetoresistive sensors 15, 15' and the Z-axis linear magnetoresistive sensors 16, 16' are anti-parallel to each other respectively. In this example, the X-axis linear magnetoresistive sensors 15, 15' and the Z-axis linear magnetoresistive sensors 16, 16' are of a gradient full bridge structure, whose bridge arm consists of one or more TMR elements electrically connected with each other. In addition, the X-axis linear magnetoresistive sensors 15, 15' and the Z-axis linear magnetoresistive sensors 16, 16' are a single resistor or gradient half bridge structure, whose bridge arm may also consist of one or more magnetoresistive elements, such as Hall, AMR, or GMR, electrically connected with each other. The excitation coil 3 is located between the two PCBs 13 and 14, and encircles the X-axis linear magnetoresistive sensors 15, 15' and the Z-axis linear magnetoresistive sensors 16, 16'. The excitation coil 3 is a single coil, but if it is necessary to enhance the signals and cause magnetic fields around the to-be-detected coin 4 generated by the signals to be more uniform, at this point, an array formed by superposing multiple coils may also be used. A diameter of circumference encircled by the excitation coil 3 is greater than or equal to that of the to-be-detected coin 4. The excitation coil 3 is positioned by the upper and lower PCBs 13 and 14, such that the to-be-detected coin 4 is located on one side thereof. In this embodiment, the to-be-detected coin 4 is located above the excitation coil 3. Specifically, the surface of the to-be-detected coin 4 is parallel to a central plane (shown by the horizontal dotted line in FIG. 2) of the excitation coil 3, and a distance between the surface of the to-be-detected coin 4 and the central plane of the excitation coil 3 is at least half of the height H of the excitation coil. A current direction in the excitation coil 3 is as shown by 17 and 18 in FIG. 2, that is, comes in from 17 and goes out of 18, the current direction is parallel to the central plane of the excitation coil, directions of magnetic fields generated at the X-axis linear magnetoresistive sensors 15, 15' are the same, directions of magnetic fields generated at the Z-axis linear magnetoresistive sensors 16, 16' are also the same, but their sensing directions are opposite to each other respectively, and thus they may offset each other through operations, which does not affect measurement results. Compared with the X-axis linear magnetoresistive sensor 15' and the Z-axis linear magnetoresistive sensor 16', the X-axis linear magnetoresistive sensor 15 and the Z-axis linear magnetoresistive sensor 16 are closer to the to-be-detected coin 4, so as to form gradient magnetic field measurement for an eddy current field induced by the to-be-detected coin 4. The positioning column 12 in FIG. 2 and FIG. 3 is used for positioning the to-be-detected coin 4, so as to avoid influences caused by different positions where the to-be-detected coin 4 is placed, but the placement position of the positioning column 12 is not limited to that shown in the figures, which, for example, may also be placed on an opposite side of the position shown in the figures.

Figure 4A:
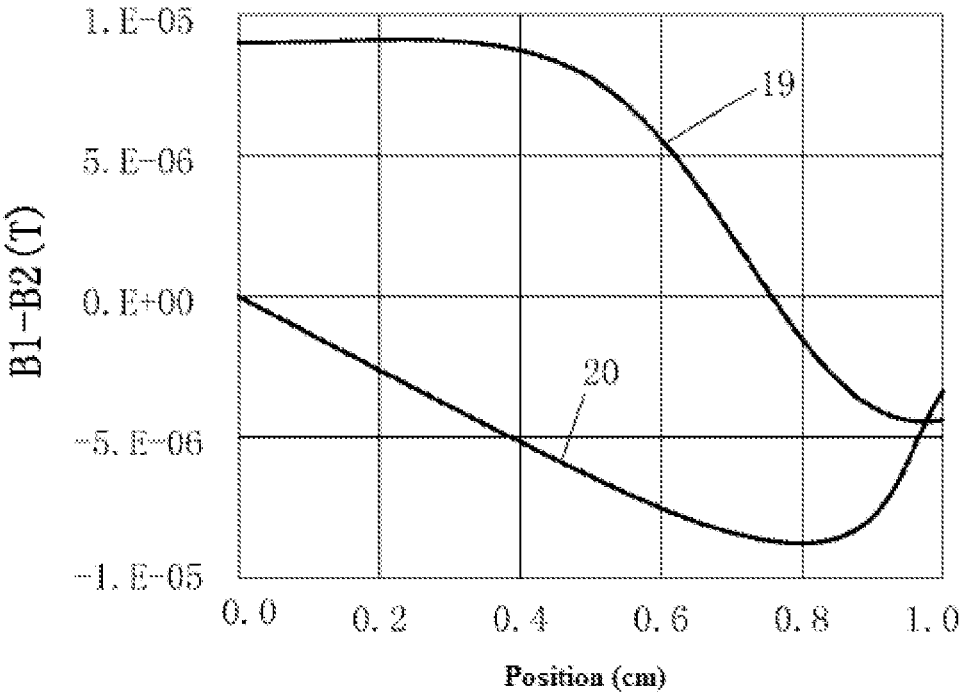
FIGS. 4A-4B are relational curves of real and imaginary components of a magnetic field around the coil vs. measurement positions when a measurement frequency is 1 KHz.
Figure 4B:
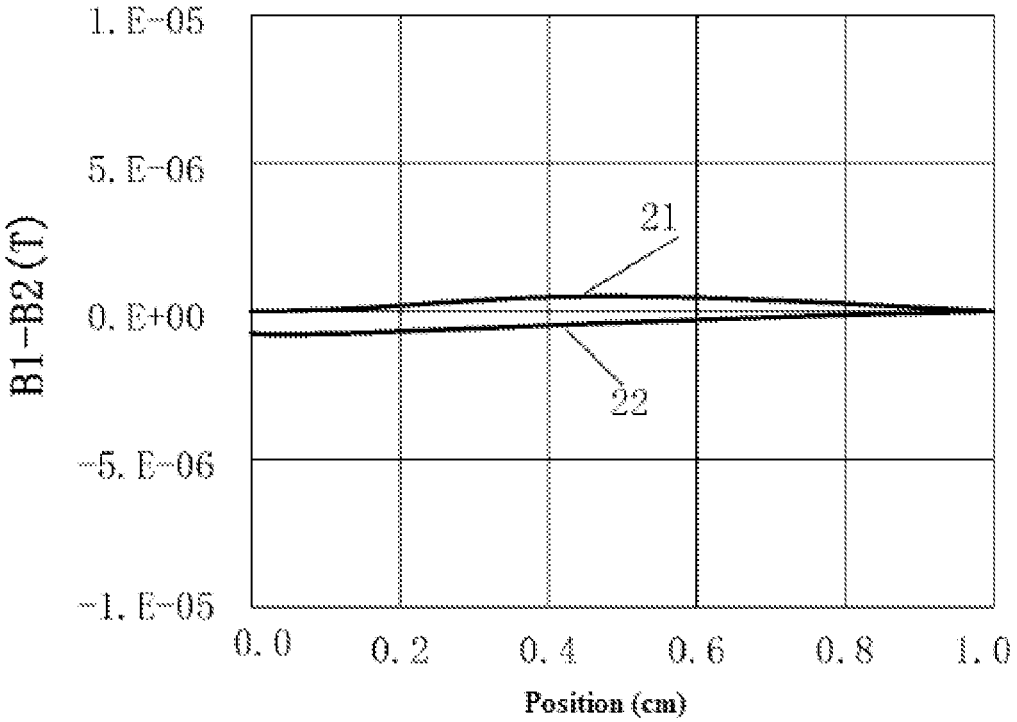

FIGS. 4A-4B are respectively relational curves of a real component and an imaginary component of an eddy current field induced by a coin made of stainless steel and coated with nickel on the surface vs. measurement positions when a measurement frequency is 1 KHz. Position 0 in the figures represents the central point of the coin. Curves 19 and 22 are analog results of the axial magnetic gradiometer, and curves 20 and 21 are analog results of the radial magnetic gradiometer. It can be seen from FIG. 4A that axial magnetic field components near the center of the coin are the greatest and uniformly distributed, while radial magnetic field components are the greatest at edges of the coin. It can be found by comparing FIG. 4A and FIG. 4B that the real component of the eddy current field induced by the coin is more affected by the measurement position.

Figure 5A:
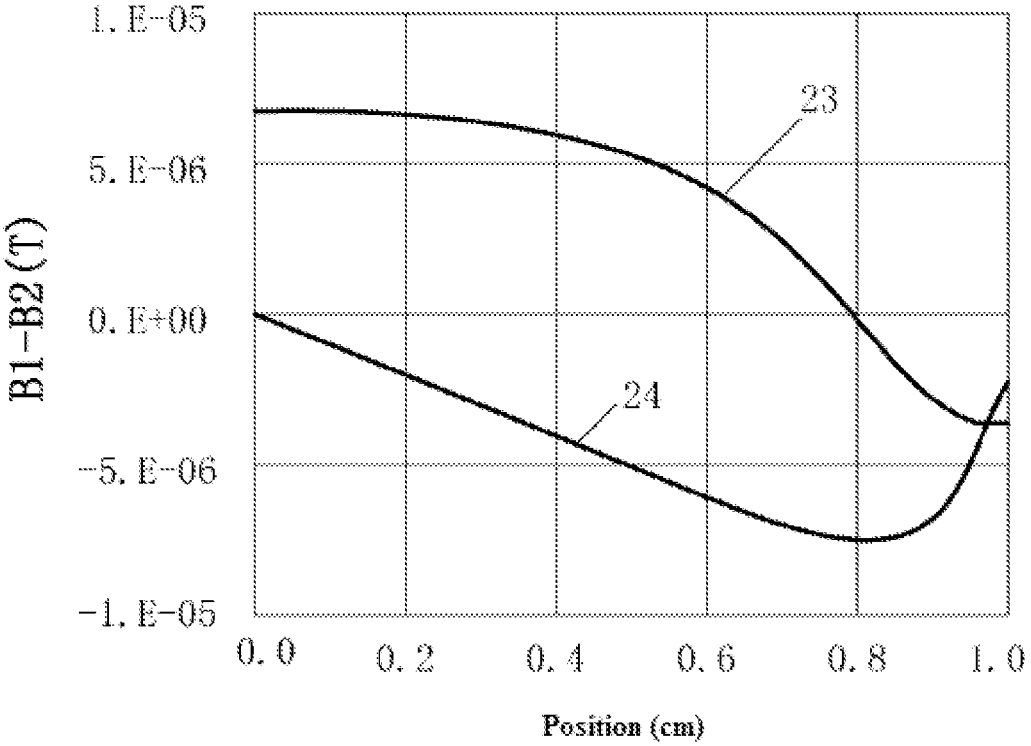
FIGS. 5A-5B are relational curves of real and imaginary components of a magnetic field around the coil vs. measurement positions when a measurement frequency is 10 KHz.
Figure 5B:
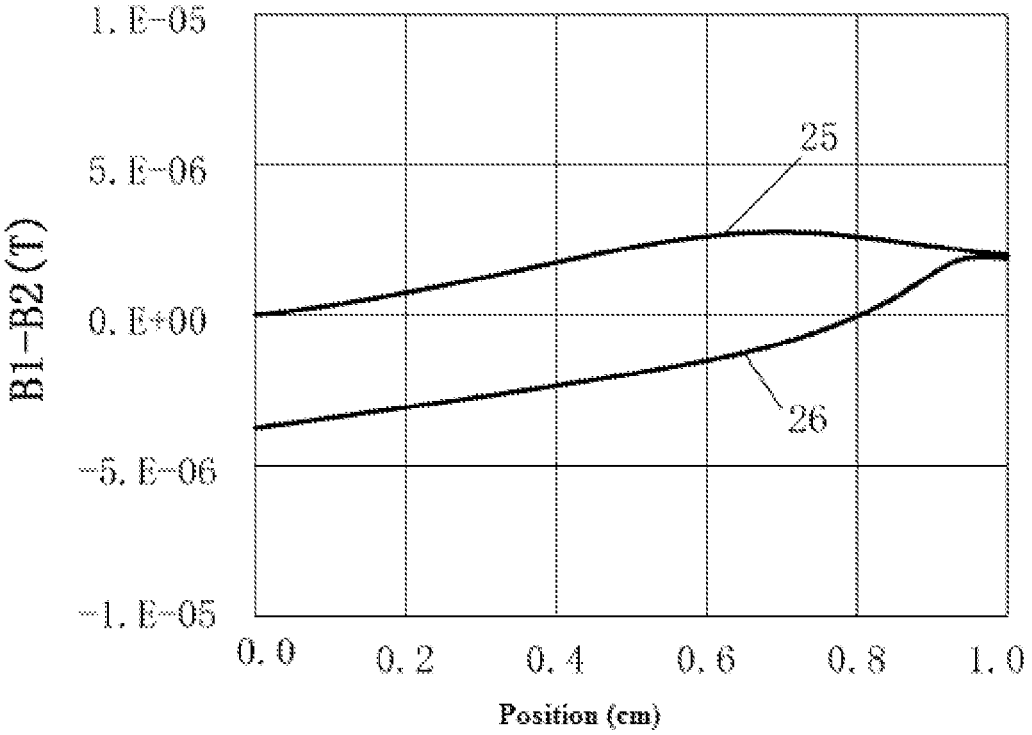

FIGS. 5A-5B are respectively relational curves of a real component and an imaginary component of a magnetic field around a coin made of stainless steel and coated with nickel on the surface vs. measurement positions when a measurement frequency is 10 KHz. Curves 23 and 26 are analog results of the axial magnetic gradiometer, and curves 24 and 25 are analog results of the radial magnetic gradiometer. A conclusion the same as that in FIG. 4 may also be derived from FIG. 5.

Figure 6A:
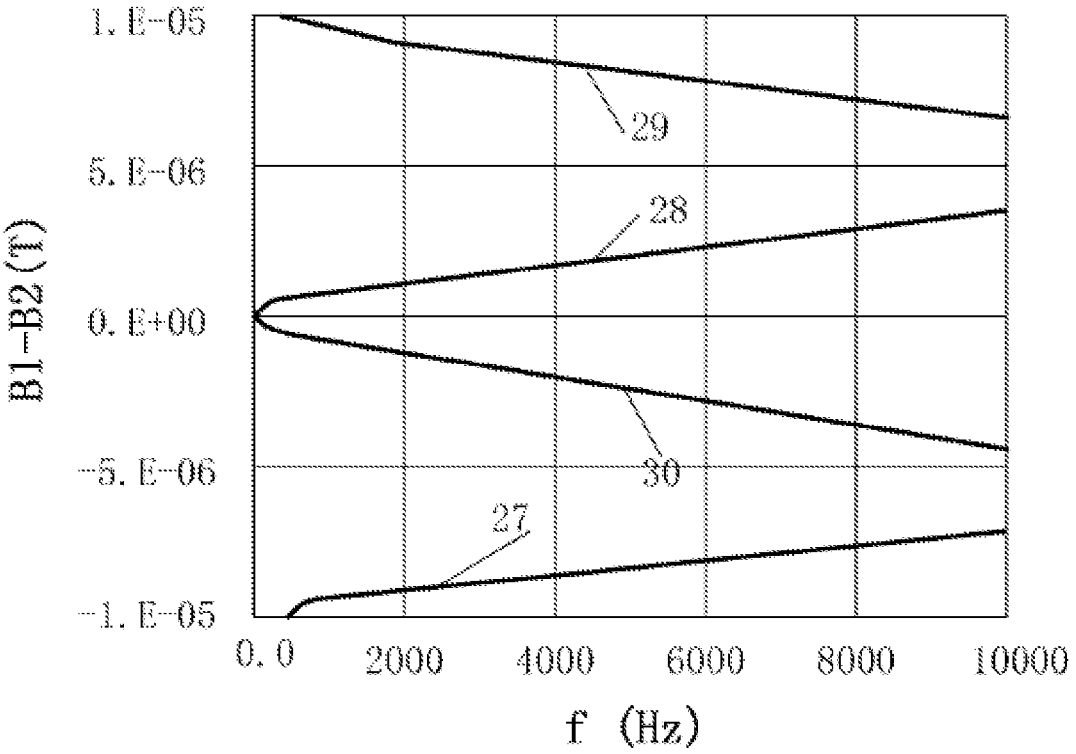
FIGS. 6A-6D are calculation results of relationships between a real component and an imaginary component of an eddy current field induced by a coin made of a different material and frequencies.
Figure 6B:
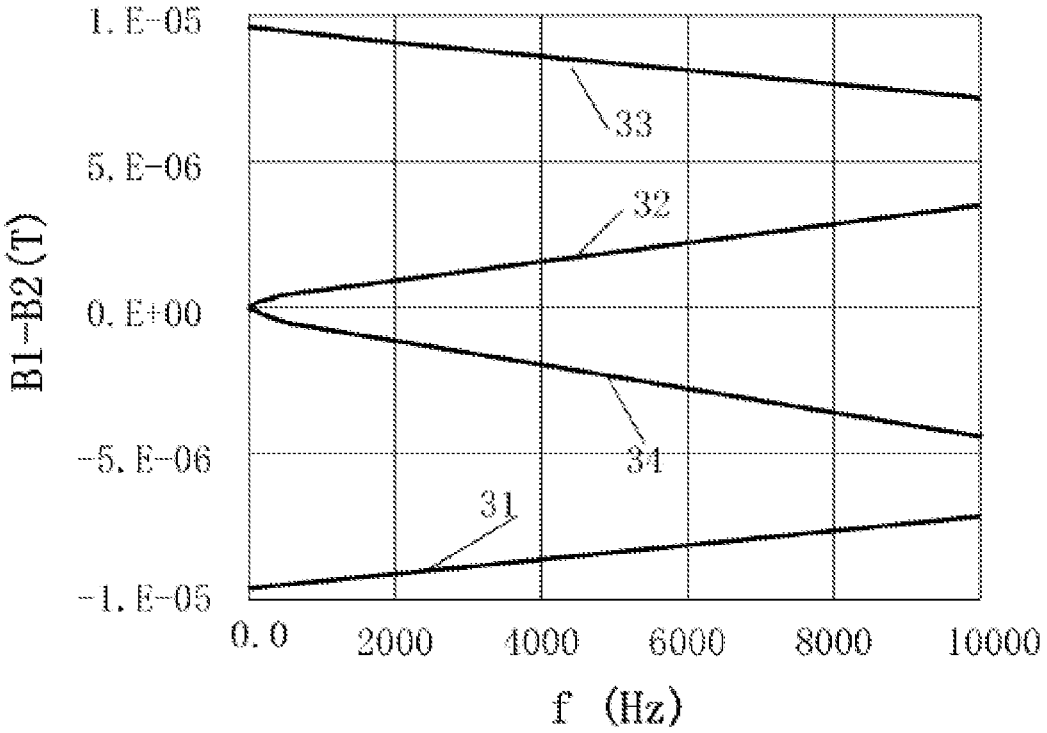
Figure 6C:
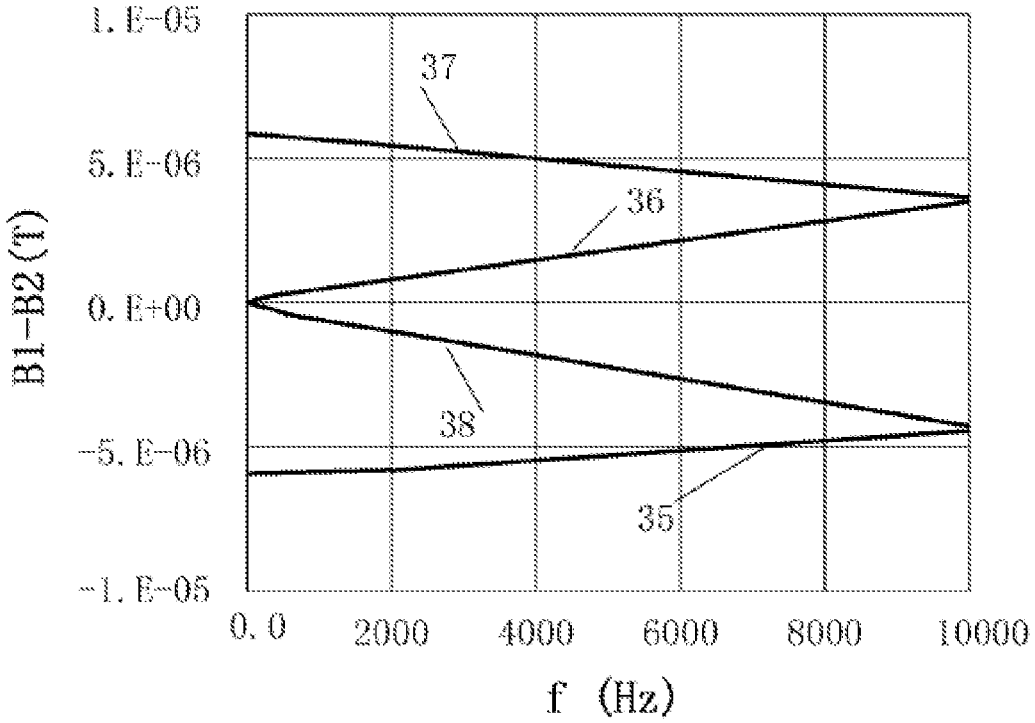
Figure 6D:
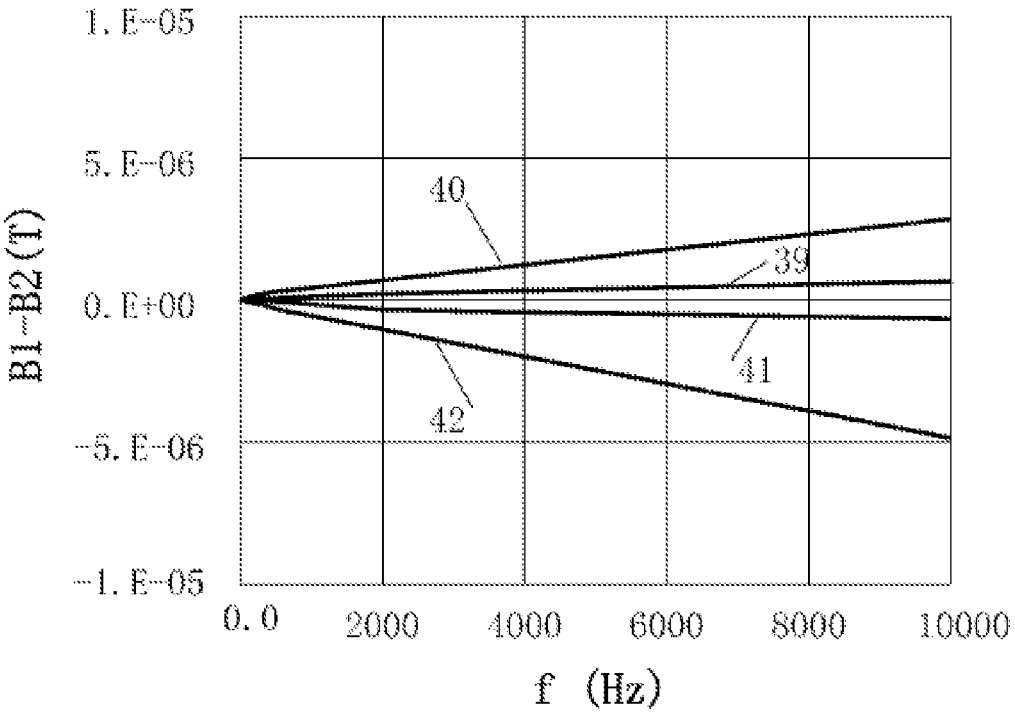

FIGS. 6A-6D are calculation results of relationships between a real component and an imaginary component of an eddy current field induced by a coin made of a different material and frequencies. In FIG. 6A, the coin is made of pure nickel, in FIG. 6B, the coin is made of stainless steel and surface-coated with nickel having a thickness of 100 um, in FIG. 6C, the coin is made of stainless steel and surface-coated with nickel having a thickness of 10 um, and in FIG. 6D, the coin is made of pure stainless steel; curves 27, 31, 35, and 39 are real components measured by the radial magnetic gradiometer, curves 28, 32, 36, and 40 are imaginary components measured by the radial magnetic gradiometer, curves 29, 33, 37, and 41 are real components measured by the axial magnetic gradiometer, and curves 30, 34, 38, and 42 are imaginary components measured by the axial magnetic gradiometer. It can be seen from the figures that measurement results are different for the coins made of different materials, the real component is more sensitive to magnetic conductance materials, while the imaginary component is sensitive to eddy currents. The denomination, material and other information of the coin can be obtained according to real and imaginary components corresponding to each frequency.

Figure 7A:
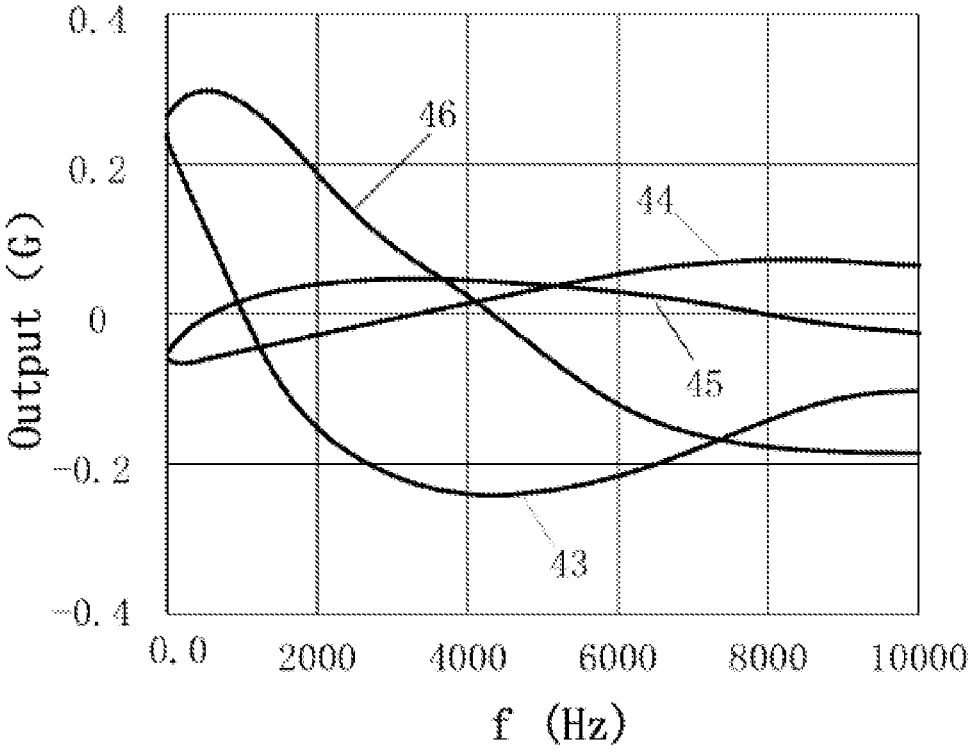
FIGS. 7A-7B are curves of testing results of coins of 1 Yuan and 0.1 Yuan.
Figure 7B:
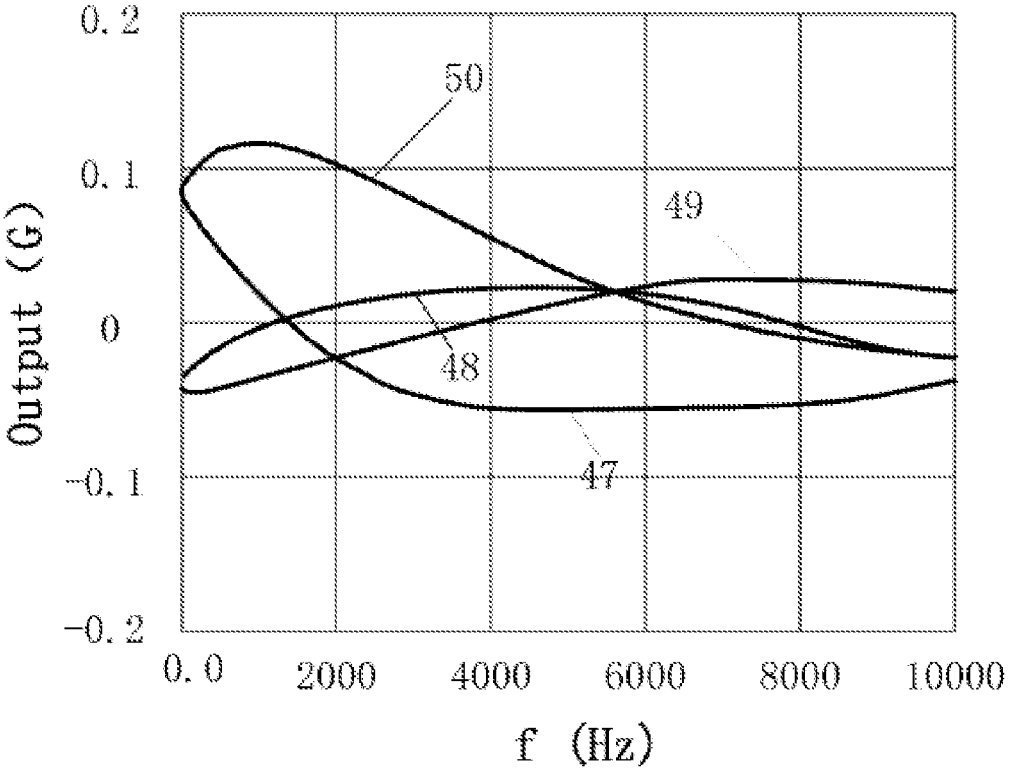

FIGS. 7A-7B are respectively curves of testing results of coins of 1 Yuan and 0.1 Yuan. Curves 44 and 45 and curves 48 and 49 are real components and imaginary components measured by the axial magnetic gradiometer respectively; and curves 43 and 46 and curves 47 and 50 are real components and imaginary components measured by the radial magnetic gradiometer respectively. It can be seen by comparing the two figures that output results are different for coins with different denominations. The denomination and authenticity of the coin can be judged by comparing a measurement result with a standard value. Measurement results of some coins at a certain frequency and in a certain direction are the same or very close, resulting in that it is difficult to judge the denomination and authenticity thereof; at this point, it is necessary to make judgment in combination with output results corresponding to multiple frequencies, as shown in FIG. 10 and FIG. 8 corresponding to FIG. 10.

Figure 8:
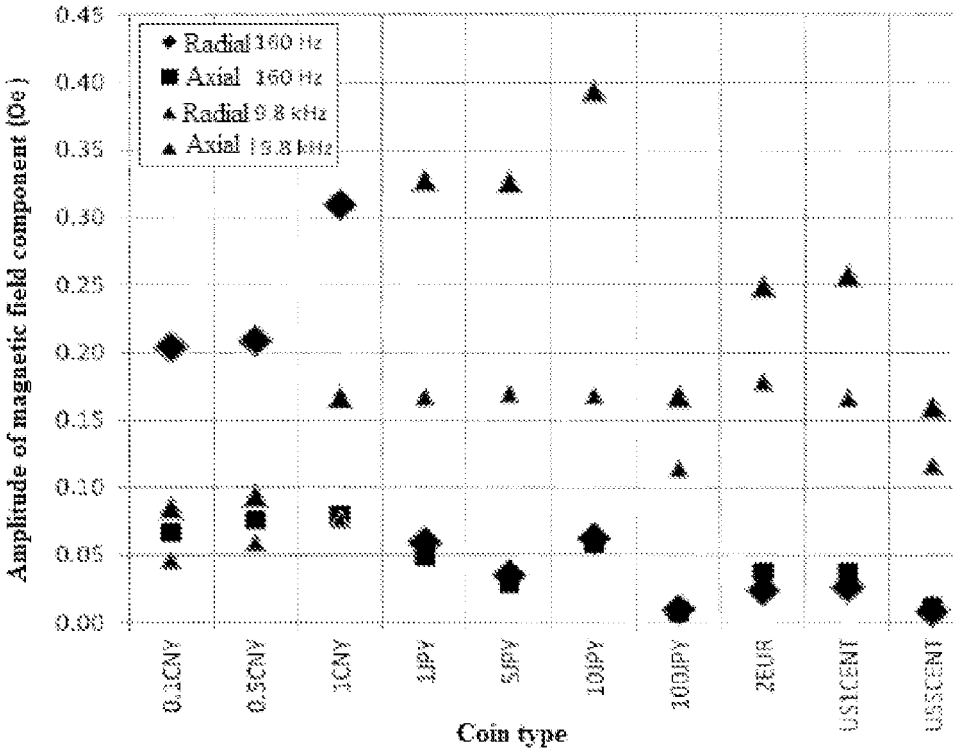
FIG. 8 is a measurement result of ten types of coins at frequencies of 160 Hz and 9800 Hz.

It can be seen from FIG. 10 and FIG. 8 that when the coins with the denominations of 1 JPY and 10 JPY are at a frequency of 9800 Hz, measurement results of the axial magnetic gradiometer are the same, and the denominations can be identified only in combination with the measurement results of the radial magnetic gradiometer. In addition, when the coins with the denominations of 0.1 CNY and 0.5 CNY are at a frequency of 9800 Hz, amplitude values of magnetic field components in the radial direction and the axial direction are very close and are not easy to identify, at this point, the denominations of the coins can be identified accurately in combination with the measurement result when the frequency is 160 Hz, and the coins with the denominations of 100 JPY and US5CENT is just opposite to the former. When the frequency is 160 Hz, amplitude values of magnetic field components in the radial direction and the axial direction are very close and can be accurately identified only in combination with the measurement result when the frequency is 9800 Hz.

Figure 9A:
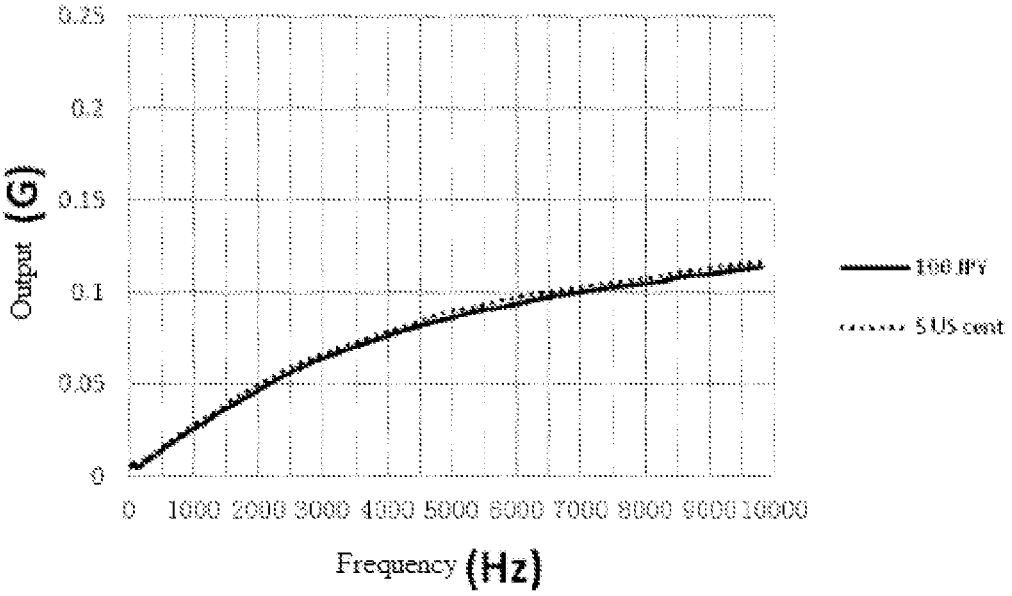
FIGS. 9A-9B are output curves obtained when an axial magnetic gradiometer and a radial magnetic gradiometer measure two types of coins respectively.
Figure 9B:
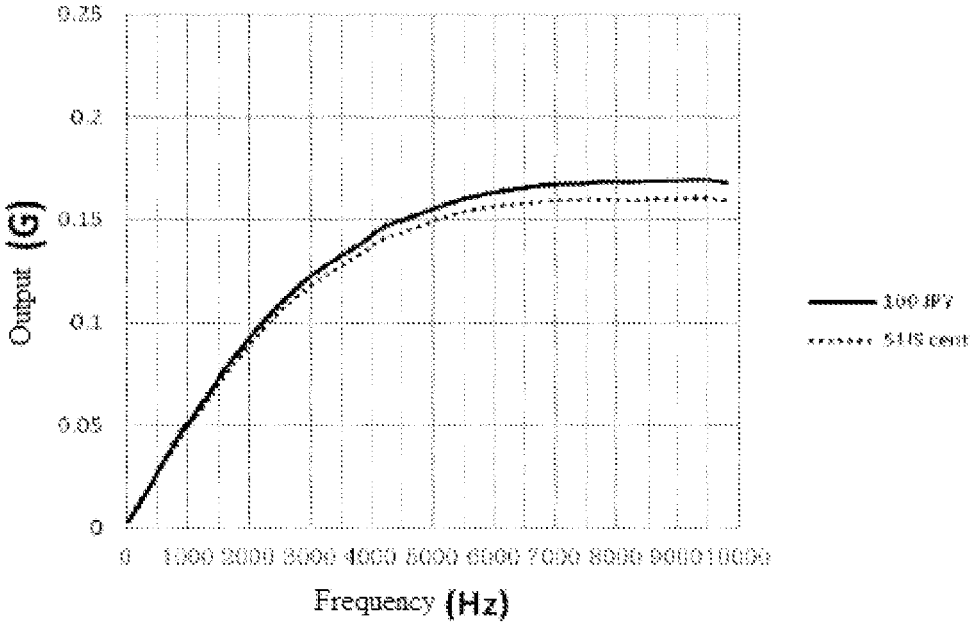

Amplitudes of magnetic field components of some coins in a certain direction are very close, and identification is very difficult when a single-axis magnetic gradiometer is used for measurement. Two coins whose denominations are 100 JPY and 5 US cent are taken as an example, as shown in FIGS. 9A-9B. FIG. 9A is a relational curve of amplitude values of magnetic field components in a Z-axis direction vs. frequencies measured by using an axial magnetic gradiometer, and FIG. 9B is a relational curve of amplitude values of magnetic field components in an X-axis direction vs. frequencies measured by using a radial magnetic gradiometer. It can be seen from the two figures that within a frequency range of 0 to 10 KHz, measurement results of the two coins in the axial direction (i.e., the Z-axis direction) are very close, measurement results in the radial direction (i.e., the X-axis direction) vary within a frequency range of 2.5 to 10 KHz, it is very difficult to judge the denominations if magnetic field components in the axial direction are measured only, and the denominations of the coins can be accurately judged only in combination with the measurement results in the X-axis direction. For some coins, the measurement results in the axial direction may be different but the measurement results in the radial direction are very close; it is thus clear that, only when magnetic field components in the radial direction and the axial direction are measured at the same time, can the denominations of the coins be identified more accurately, and then the authenticity thereof can be judged by comparing with the standard result. The coin detection system of the present invention measures magnetic field components in the radial direction and the axial direction at the same time, and thus accuracy of judging the denominations and the authenticity of the coins by using measurement results thereof is higher.

The above descriptions are merely preferred embodiments of the present invention, and are not intended to limit the present invention. For those skilled in the art, the present invention may have various modifications and changes. Any modification, equivalent replacement, improvement or the like made without departing from the spirit and principle of the present invention shall all fall within the protection scope of the present invention.

The invention claimed is:

1. A coin detection system comprising:

an excitation coil having a cylindrical shape with a radius, a height separating a first base and a second base of the cylindrical shape, and a central axis extending from the first base to the second base, a first printed circuit board and a second printed circuit board, wherein the excitation coil is between the first and second printed circuit boards, the first base being proximate to first side of the first printed circuit board and the second base being proximate to a first side of the second printed circuit board, the coin detection system being configured to detect a to-be-detected coin on a second side of the first printed circuit board that opposes the first side of the first printed circuit board, a surface of the to-be-detected coin is parallel to a central plane of the excitation coil, and a distance between the surface of the to-be-detected coin and the central plane is at least half of the height of the excitation coil;

a radial magnetic gradiometer comprising at least two radial magnetoresistive sensors to detect magnetic field components, the at least two radial magnetoresistive sensors including a first radial magnetoresistive sensor on the first printed circuit board and a second radial magnetoresistive sensor on the second printed circuit board, the first radial magnetoresistive sensor having a sensitive direction in a first radial direction and the second radial magnetoresistive sensor having a sensitive direction in a second radial direction opposite the first radial direction, the radial magnetic gradiometer configured to generate a signal indicative of a detected difference of the detected magnetic field components between the first and second radial magnetoresistive sensors, an axial magnetic gradiometer comprising at least two axial magnetoresistive sensors to detect magnetic field components, the at least two axial magnetoresistive sensors including a first axial magnetoresistive sensor on the first printed circuit board and a second axial magnetoresistive sensor on the second printed circuit board, the first axial magnetoresistive sensor having a sensitive direction in a first axial direction and the second axial magnetoresistive sensor having a sensitive direction in a second axial direction opposite the first axial direction, the axial magnetic gradiometer configured to generate a signal indicative of a detected difference of the detected magnetic field components between the first and second axial magnetoresistive sensors, a signal excitation source and a drive circuit configured to excite the excitation coil using a signal having one or more frequency components, an analog front-end circuit configured to amplify signals generated by the radial magnetic gradiometer and the axial magnetic gradiometer, wherein the amplified signals have the one or more frequency components of the signal used to excite the excitation coil, and a processor configured to calculate a real component and an imaginary component for each of the one or more frequency components of the amplified signals, determine amplitude values of the real component and the imaginary component to detect each of a plurality of coin types based on the determined amplitude values;

wherein the excitation coil is configured to provide an axial excitation magnetic field with the one or more frequency components for a to-be-detected coin to induce eddy currents at the one or more frequency components inside the to-be-detected coin, and the eddy currents generate an induced magnetic field that cause measurable magnetic field gradients; and wherein the radial magnetoresistive sensors and the axial magnetoresistive sensors are symmetrically distributed relative to the excitation coil such that outputs of both the radial magnetic gradiometer and the axial magnetic gradiometer are both zero in the absence of the to-be-detected coin.

2. The coin detection system according to claim 1, wherein the signal is an AC signal, and the signal excitation source is configured to apply a DC signal for a duration of the AC signal, and wherein the excitation magnetic field generated by the excitation coil is a superposed field of a DC magnetic field and an AC magnetic field.

3. The coin detection system according to claim 2, wherein, when the to-be-detected coin is made of a ferromagnetic material or a surface of the to-be-detected coin is coated with a ferromagnetic material, an amplitude value of the amplified signals is reduced after the DC magnetic field is applied; and wherein, when the to-be-detected coin is made of a conductor, the DC magnetic field does not affect the amplitude value of the amplified signals.

4. The coin detection system according to claim 1, wherein the excitation coil is a single coil or an array formed by superposing multiple coils, and wherein a diameter of a circumference encircled by the excitation coil is greater than or equal to that of the to-be-detected coin.

5. The coin detection system according to claim 1, wherein the radial magnetic gradiometer is located at an inner edge of the excitation coil and located below an edge of the to-be-detected coin, and the radial magnetoresistive sensors are symmetrical relative to the center of the excitation coil;

wherein the axial magnetic gradiometer is located inside the excitation coil and located at or close to a lower side of the center of the to-be-detected coin; and wherein the axial magnetoresistive sensors are symmetrically distributed relative to the center of the excitation coil along the axial direction of the excitation coil.

6. The coin detection system according to claim 1, wherein the radial magnetoresistive sensors are X-axis linear sensors, wherein the axial magnetoresistive sensors are Z-axis linear sensors, wherein sensing directions of the X-axis linear sensors are parallel to the radial direction of the to-be-detected coin, and wherein sensing directions of the Z-axis linear sensors are parallel to the axial direction of the to-be-detected coin.

7. The coin detection system according to claim 6, wherein the X-axis linear sensors and the Z-axis linear sensors are of a structure of a single resistor, half bridge or full bridge, and wherein the single resistor, bridge arms of the half bridge or bridge arms of the full bridge consist of one or more magnetoresistive elements electrically connected with each other.

8. The coin detection system according to claim 7, wherein the magnetoresistive elements are Hall, anisotropic magnetoresistance (AMR), giant magnetoresistance (GMR), tunnel magnetoresistance (TMR) or semiconductor magnetoresistive elements.

9. The coin detection system according to claim 1, wherein the coin detection system further comprises a positioning device for positioning a position where the to-be-detected coin is placed, such that the to-be-detected coin is close to one side of the radial magnetic gradiometer and the axial magnetic gradiometer.

10. A coin detection system comprising:

an excitation coil having a cylindrical shape with a radius, a height separating a first base and a second base of the cylindrical shape, and a central axis extending from the first base to the second base, a first printed circuit board and a second printed circuit board, wherein the excitation coil is between the first and second printed circuit boards, the first base being proximate to first side of the first printed circuit board and the second base being proximate to a first side of the second printed circuit board, the coin detection system being configured to detect a to-be-detected coin on a second side of the first printed circuit board that opposes the first side of the first printed circuit board, a surface of the to-be-detected coin is parallel to a central plane of the excitation coil, and a distance between the surface of the to-be-detected coin and the central plane is at least half of the height of the excitation coil; and a radial magnetic gradiometer comprising at least two radial magnetoresistive sensors to detect magnetic field components, the at least two radial magnetoresistive sensors including a first radial magnetoresistive sensor on the first printed circuit board and a second radial magnetoresistive sensor on the second printed circuit board, the first radial magnetoresistive sensor having a sensitive direction in a first radial direction and the second radial magnetoresistive sensor having a sensitive direction in a second radial direction opposite the first radial direction, the radial magnetic gradiometer configured to generate a signal indicative of a detected difference of the detected magnetic field components between the first and second radial magnetoresistive sensors, an axial magnetic gradiometer comprising at least two axial magnetoresistive sensors to detect magnetic field components, the at least two axial magnetoresistive sensors including a first axial magnetoresistive sensor on the first printed circuit board and a second axial magnetoresistive sensor on the second printed circuit board, the first axial magnetoresistive sensor having a sensitive direction in a first axial direction and the second axial magnetoresistive sensor having a sensitive direction in a second axial direction opposite the first axial direction, the axial magnetic gradiometer configured to generate a signal indicative of a detected difference of the detected magnetic field components between the first and second axial magnetoresistive sensors, the first and second radial magnetoresistive sensors and the first and second axial magnetoresistive sensors being encircled by the excitation coil.

11. A coin detection system comprising:

an excitation coil having a cylindrical shape with a radius, a height separating a first base and a second base of the cylindrical shape, and a central axis extending from the first base to the second base, wherein a surface of the to-be-detected coin is parallel to a central plane of the excitation coil, and a distance between the surface of the to-be-detected coin and the central plane is at least half of the height of the excitation coil; and a radial magnetic gradiometer comprising a first radial magnetoresistive sensor having a sensitive direction in a first radial direction and a second radial magnetoresistive sensor having a sensitive direction in a second radial direction opposite the first radial direction, the radial magnetic gradiometer configured to generate a signal indicative of a detected difference of the detected magnetic field components between the first and second radial magnetoresistive sensors, an axial magnetic gradiometer comprising a first axial magnetoresistive sensor having a sensitive direction in a first axial direction and a second axial magnetoresistive sensor having a sensitive direction in a second axial direction opposite the first axial direction, the axial magnetic gradiometer configured to generate a signal indicative of a detected difference of the detected magnetic field components between the first and second axial magnetoresistive sensors, wherein the first and second radial magnetoresistive sensors and the first and second axial magnetoresistive sensors are encircled by the excitation coil.

* * * * *